US006748888B1

(12) United States Patent
Chen

(10) Patent No.: US 6,748,888 B1
(45) Date of Patent: Jun. 15, 2004

(54) DIRECTLY MOTOR-DRIVEN STRUCTURE OF A SEWING MACHINE

(75) Inventor: Shih-Fang Chen, Taipei (TW)

(73) Assignee: Ching Chi Machines Co., Ltd., Taipei Hsien (TW)

( * ) Notice: Subject to any disclaimer, the term of this patent is extended or adjusted under 35 U.S.C. 154(b) by 0 days.

(21) Appl. No.: 10/602,867

(22) Filed: Jun. 25, 2003

(51) Int. Cl.[7] ..... D05B 69/12
(52) U.S. Cl. ..... 112/220
(58) Field of Search ..... 112/220, 221, 112/284, 258, 259; 310/46, 80; 464/178, 179; 474/84, 123, 205

(56) References Cited

U.S. PATENT DOCUMENTS 1,130,309 A * 3/1915 Mace ..... 112/220
2,161,142 A * 6/1939 De Voe ..... 112/221
2,322,397 A * 9/1943 Smith ..... 112/63
4,714,037 A * 12/1987 Johnson et al. ..... 112/184
5,125,354 A * 6/1992 Hayashi et al. ..... 112/259

FOREIGN PATENT DOCUMENTS

JP 40269997 * 9/1992

* cited by examiner

*Primary Examiner*—Ismael Izaguirre
(74) *Attorney, Agent, or Firm*—Rosenberg, Klein & Lee

(57) ABSTRACT

A directly motor-driven structure of a sewing machine, including: a middle rotary shaft pivotally mounted in a middle section of the housing between the upper and lower driving shafts. A first transmission mechanism connected between the lower driving shaft and the middle rotary shaft. A second transmission mechanism connected between the upper driving shaft and the middle rotary shaft. The first transmission mechanism is spaced from the lower stitching needle by a first length. The second transmission mechanism is spaced from the upper stitching needle by a second length. The second length is smaller than the first length, whereby the sewing machine is formed with a recessed installation space adjacent to the second transmission mechanism. A driving motor is installed in the recessed installation space and directly fixedly connected with the upper driving shaft.

5 Claims, 4 Drawing Sheets

DIRECTLY MOTOR-DRIVEN STRUCTURE OF A SEWING MACHINE

BACKGROUND OF THE INVENTION

1. Field of the Invention

The present invention is related to a directly motor-driven structure of a sewing machine, in which the driving motor is a high power motor with small volume and can directly drive the upper driving shaft to greatly reduce the noise and minify the vibration in operation. Moreover, the conventional fixing bracket for mounting the driving motor is omitted. Therefore, the structure and installation procedure are simplified.

2. Description of the Prior Art

FIGS. 1 and 2 show an existent sewing machine, especially an industrial sewing machine 40. The driving motor 41 is locked under the table board 43 by a fixing bracket 42. A belt wheel 44 is fixedly mounted on the rotary shaft of the driving motor 41. Sequentially through a belt 45 and a belt wheel 46, the belt wheel 44 drives the lower driving shaft 48 pivotally disposed in the lower section of the housing 47 of the sewing machine. A belt wheel 49 is fixedly mounted on the lower driving shaft 48. Through a belt 50 and a belt wheel 51 of the upper driving shaft 52, the belt wheel 49 drives the upper driving shaft 52 pivotally disposed in the upper section of the housing 47 of the sewing machine. Accordingly, the upper and lower driving shafts 52, 48 synchronously respectively drive the upper and lower stitching needles (not shown) to perform sewing operation. In order to reduce the vibration generated in operation of the sewing machine, the bottom face of the entire sewing machine 40 is locked on the upper face of the table board 43 by four bolts. However, the vibration can be hardly eliminated. Therefore, the sewing machine is simply "placed" on four buffering pads 53 and can be hardly fir locked by the bolts. Such structure has some shortcomings in use as follows:

1. The transmission distance of the belt 45 is too long. In the case that the belt 45 is over-tensioned, in operation, the sewing machine will vibrate to make a noise.

2. In the case that the belt 45 is over-tensioned, when the belt 45 is revolved on the upper and lower belt wheels 46, 44, a noise will be produced.

3. The driving motor 41 has a large volume and heavy weight and must be locked on the table board 43 of the sewing machine by the fixing bracket 42. Therefore, the sewing machine has a quite large volume and heavy weight and cannot be easily transferred.

4. The driving motor 41 is exposed to outer side of the sewing machine and not shaded. Therefore, the driving motor 41 tends to be contaminated by dust. Moreover, the belt 45 revolves on outer side of the sewing machine and is likely to tangle with alien article or even hurt a user's fingers.

Many kinds of improved motors with small volume and great torque have been developed. In the case that such driving motor is directly mounted on the sewing machine and the driving shaft of the motor is directly drivingly coupled with any rotary shaft of the sewing machine, the noise produced in transmission can be greatly reduced. In addition, the installation can be facilitated. However, it is necessary to consider the following problem:

Referring to FIG. 2, many transmission members are disposed on left side of the belt wheel 46 so that the belt wheel 46 cannot be retracted inward, that is, retracted leftward according to FIG. 2. Besides, the upper and lower belt wheels 51, 49 must be mounted in the housing 47 of the sewing machine 40 in alignment with each other. In the case that the driving motor 41 is mounted in lower section of the housing 47, that is, mounted at right end of the lower driving shaft 48, the driving motor 41 will protrude outward from right end of the housing 47. As a result, the gravity center of the driving motor will suspend outside the housing 47. Therefore, after the driving motor is added to the sewing machine, the gravity center of the entire sewing machine will moved rightward. Accordingly, when operating, the sewing machine is likely to vibrate and produce noise.

SUMMARY OF THE INVENTION

It is therefore a primary object of the present invention to provide a directly motor-driven structure of a sewing machine. The sewing machine includes: an upper driving shaft mounted on upper side of a housing of the sewing machine for driving an upper stitching needle; a lower driving shaft mounted on lower side of the housing for driving a lower stitching needle; and a driving motor for driving the upper and lower driving shafts, making the upper and lower stitching needles perform sewing operation. The directly motor-driven structure includes: a middle rotary shaft pivotally mounted in a middle section of the housing between the upper and lower driving shafts; a first transmission mechanism connected between the lower driving shaft and the middle rotary shaft to drivingly rotatably connect the lower driving shaft with the middle rotary shaft, the first transmission mechanism being spaced from the lower stitching needle by a first length; and a second transmission mechanism connected between the upper driving shaft and the middle rotary shaft to drivingly rotatably connect the upper driving shaft with the middle rotary shaft. The second transmission mechanism is spaced from the upper stitching needle by a second length. The second length is smaller than the first length, whereby the sewing machine is formed with a recessed installation space adjacent to the second transmission mechanism. The driving motor is installed in the recessed installation space and directly fixedly connected with the upper driving shaft so as to reduce the noise in transmission. The total volume of the sewing machine is reduced. Moreover, the conventional fixing bracket for mounting the driving motor under the table board is omitted. Therefore, the structure and installation procedure are simplified.

The present invention can be best understood through the following description and accompanying drawings wherein:

DETAILED DESCRIPTION OF THE PREFERRED EMBODIMENT

Figure 1:
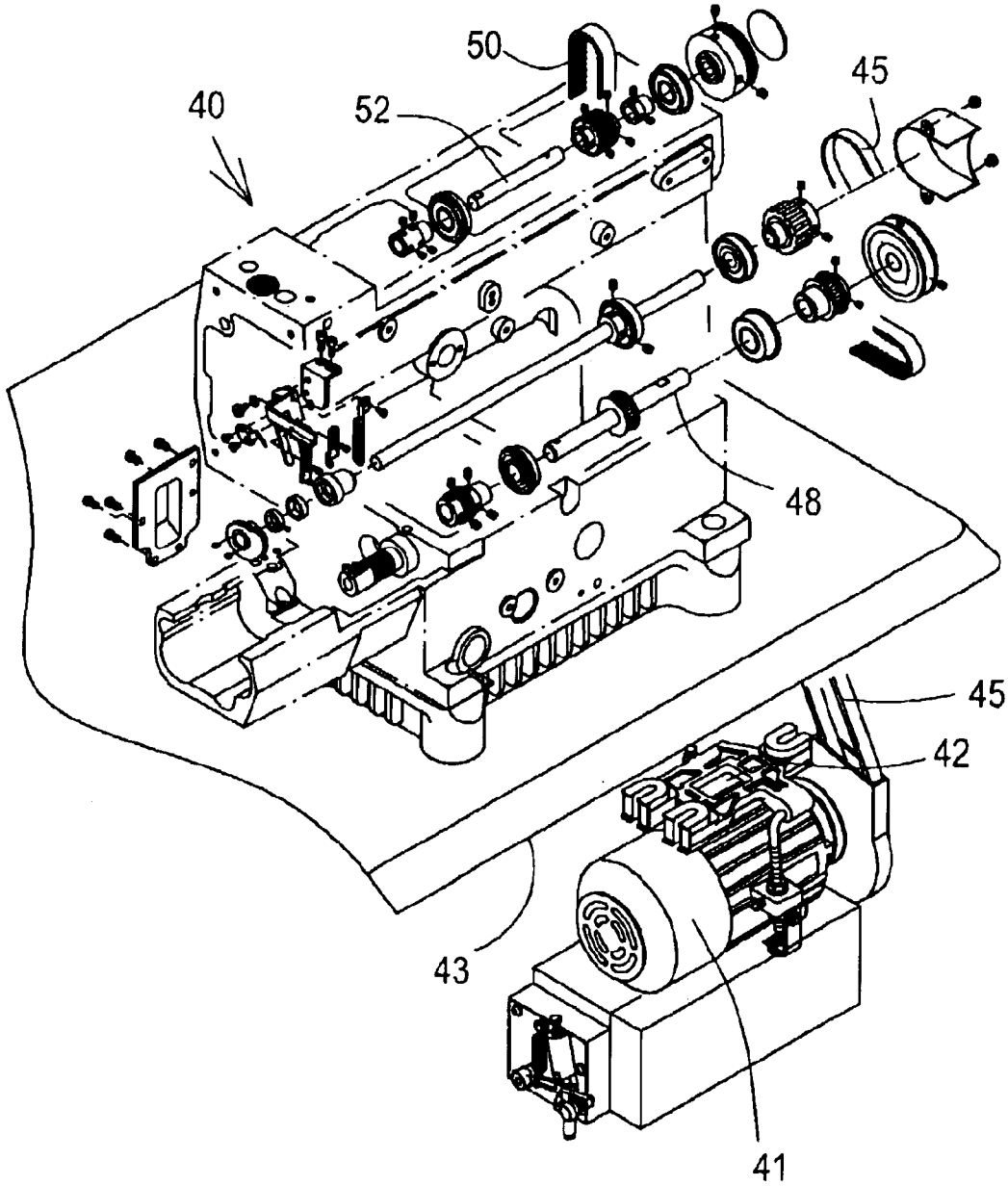
Fig. 1 PRIOR ART
FIG. 1 is a perspective partially exploded view of a conventional sewing machine.
Figure 2:
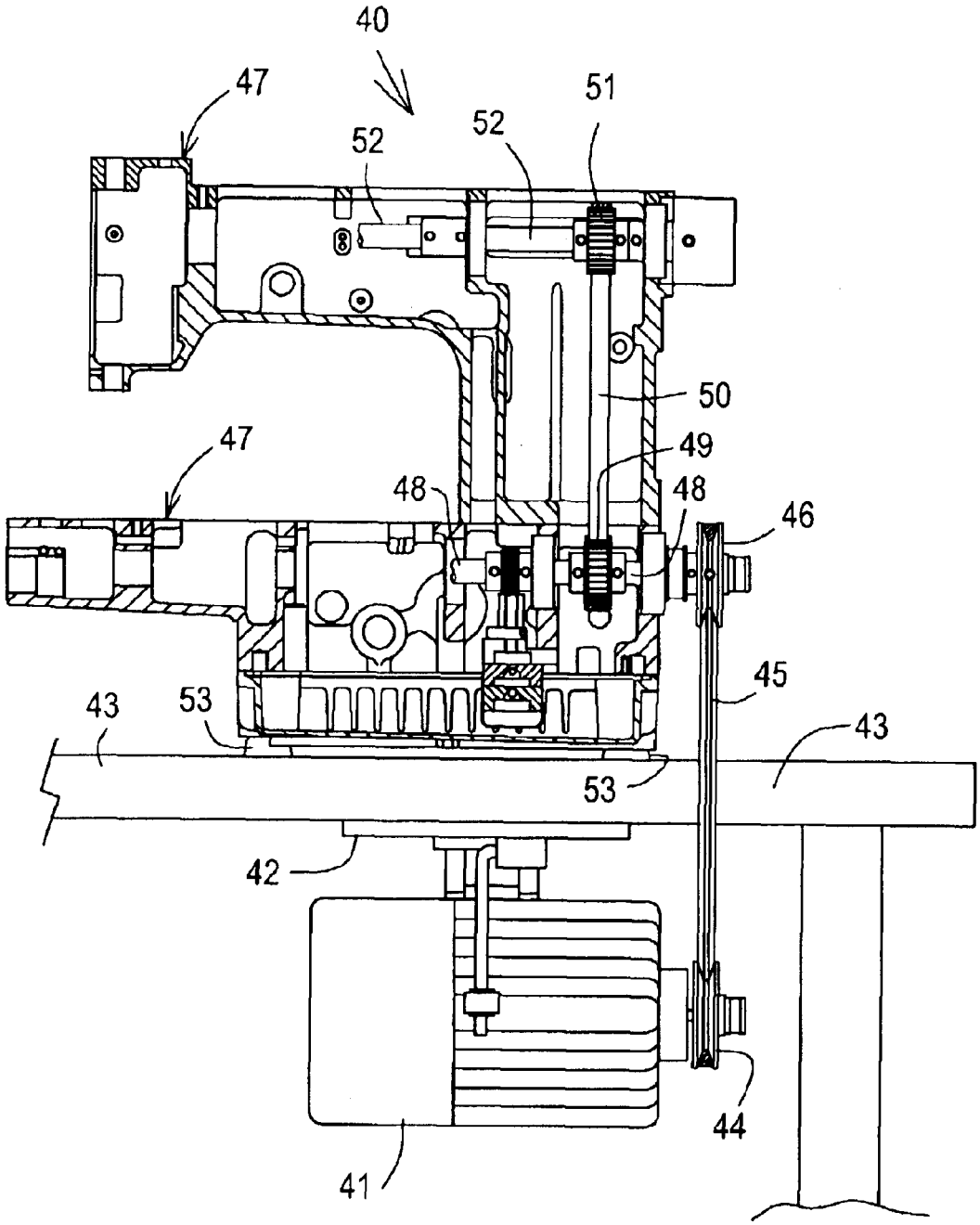
Fig. 2 PRIOR ART
FIG. 2 is a plane view of the driving structure of the conventional sewing machine.
Figure 3:
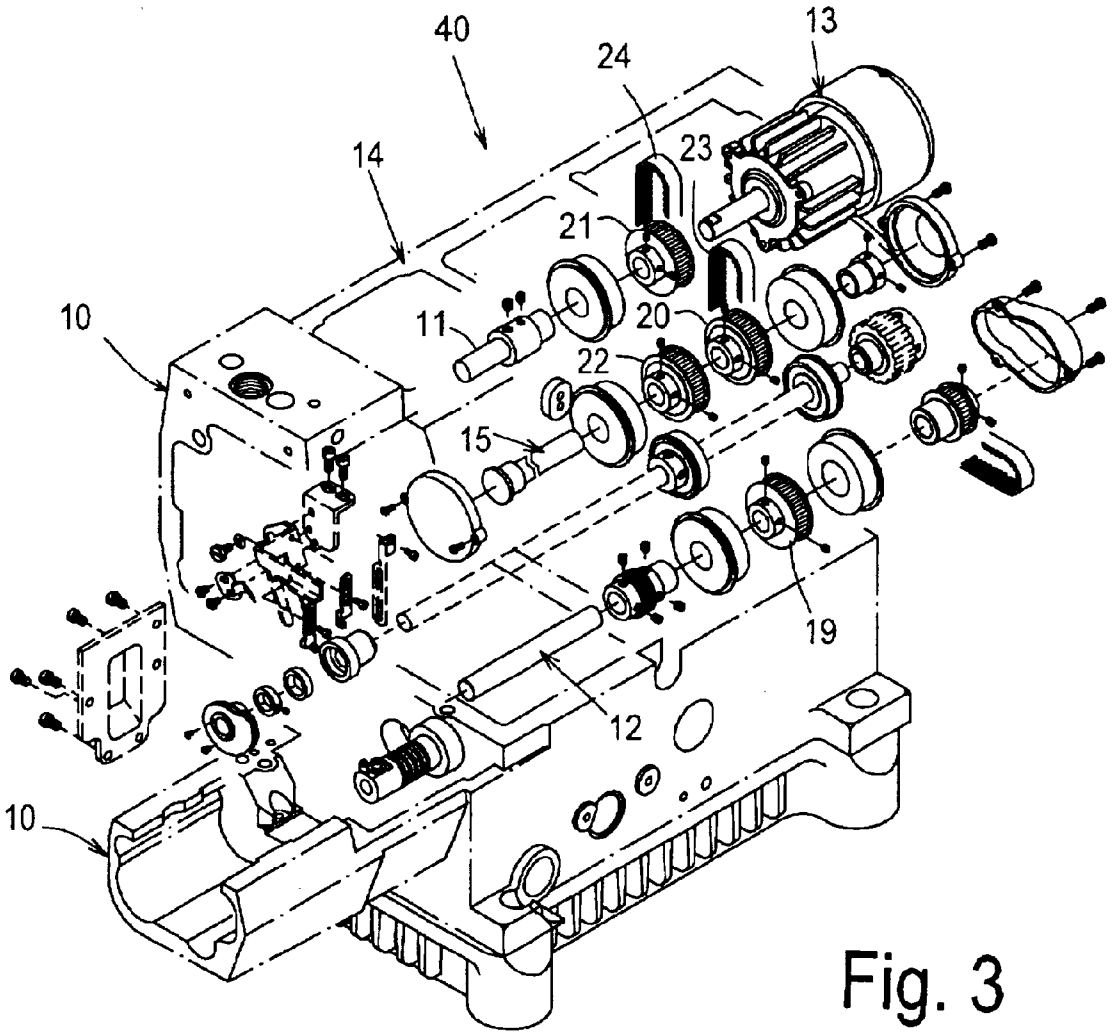
FIG. 3 is a perspective exploded view of the present invention.
Figure 4:
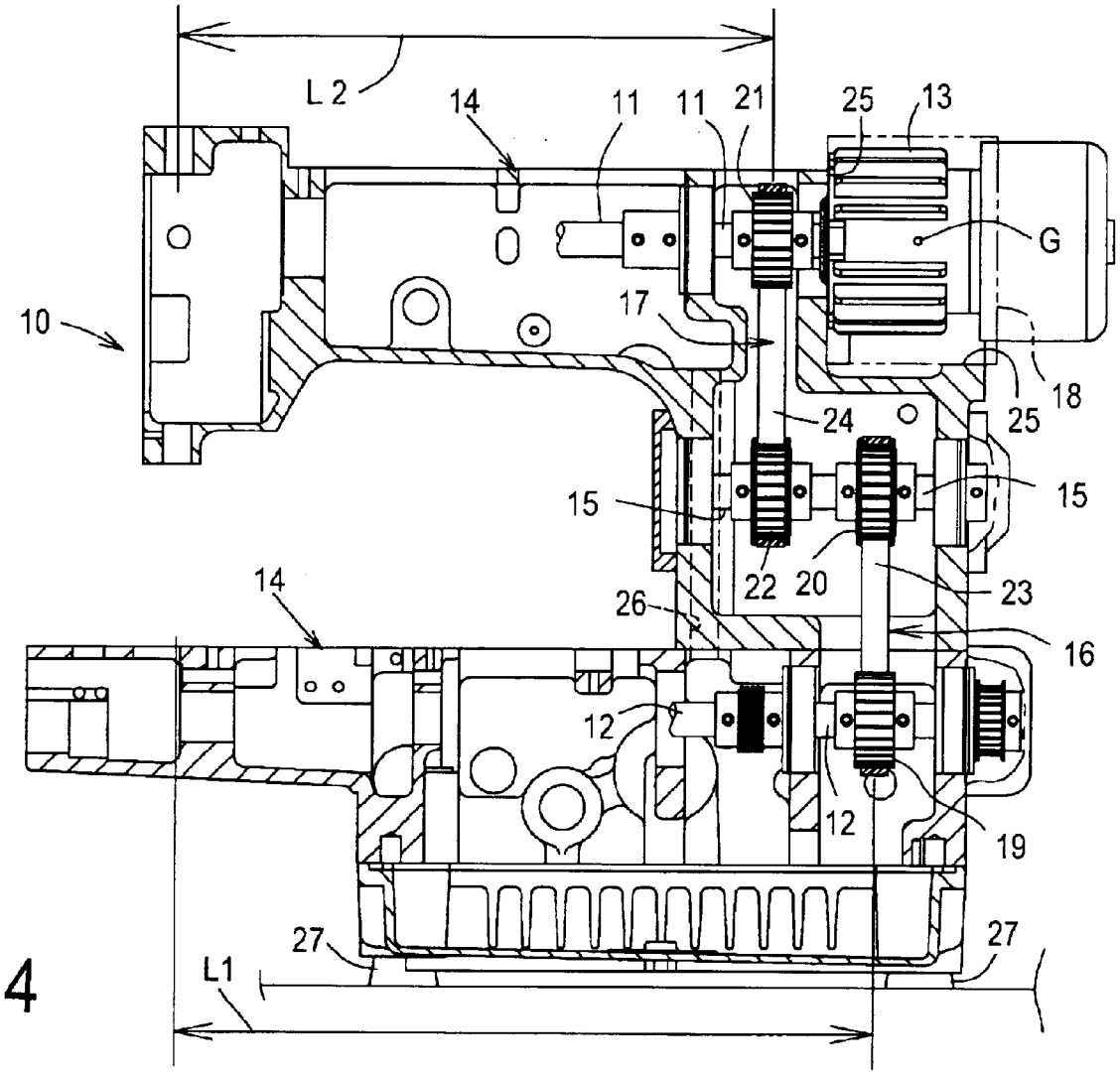
FIG. 4 is a plane view of the present invention.

Please refer to FIGS. 3 and 4. The sewing machine 10 includes an upper driving shaft 11, a lower driving shaft 12 and a driving motor 13. The upper driving shaft 11 is mounted on upper side of the housing 14 of the sewing machine 10 for driving an upper stitching needle (not shown). The lower driving shaft 12 is mounted on lower side of the housing 14 for driving a lower stitching needle (not shown). The driving motor 13 serves to drive the upper and lower driving shafts 11, 12, making the upper and lower stitching needles perform sewing operation.

The directly motor-driven structure of the sewing machine of the present invention includes a middle rotary shaft 15, a first transmission mechanism 16 and a second transmission mechanism 17. The middle rotary shaft 15 is pivotally mounted in the middle section of the housing 14 between the upper and lower driving shafts 11, 12. The first transmission mechanism 16 is connected between the lower driving shaft 12 and the middle rotary shaft 15 to drivingly rotatably connect the lower driving shaft 12 with the middle rotary shaft 15. The first transmission mechanism 16 is spaced from the lower stitching needle by a first length L1. The second transmission mechanism 17 is connected between the upper driving shaft 11 and the middle rotary shaft 15 to drivingly rotatably connect the upper driving shaft 11 with the middle rotary shaft 15. The second transmission mechanism 17 is spaced from the upper stitching needle by a second length L2. The second length L2 is smaller than the first length L1, that is, L2<L1, whereby the sewing machine 10 is formed with a recessed installation space 18 adjacent to the second transmission mechanism 17. A driving motor installation seat 25 is disposed in the installation space 18. The driving motor 13 is mounted on the motor installation seat 25 in the installation space 18 and directly fixedly connected with the upper driving shaft 11. Accordingly, the driving motor 13 can directly drive the upper driving shaft 11 to reduce the noise and minify the vibration. In addition, by means of the recessed installation space 18, the driving motor 13 can be mounted in the housing 14 of the sewing machine 10 without protruding from the housing 14. Moreover, the gravity center G of the driving motor 13 is kept within a range defined between four buffering pads 27. Therefore, when the driving motor 13 rotates, the sewing machine 10 will not vibrate so that the original stability of the entire sewing machine 10 will not be destructed.

The first transmission mechanism 16 includes a first transmission wheel 19 fixedly mounted on the lower driving shaft 12, a second transmission wheel 20 fixedly mounted on the middle rotary shaft 15 and a first flexible transmission member 23. The rims of the first and second transmission wheels 19, 20 are toothed so that the first and second transmission wheels 19, 20 are belt wheels. The first flexible transmission member 23 is wound on the first and second transmission wheels 19, 20, whereby the lower driving shaft 12 is drivingly rotatably connected with the middle rotary shaft 15.

The second transmission mechanism 17 includes a third transmission wheel 21 fixedly mounted on the upper driving shaft 11, a fourth transmission wheel 22 fixedly mounted on the middle rotary shaft 15 and a second flexible transmission member 24. The rims of the third and fourth transmission wheels 21, 22 are toothed so that the third and fourth transmission wheels 21, 22 are belt wheels. The second flexible transmission member 24 is wound on the third and fourth transmission wheels 21, 22, whereby the upper driving shaft 11 is drivingly rotatably connected with the middle rotary shaft 15.

The driving motor 1 of the present invention is a high power motor with small volume, which can be directly fixedly mounted on the motor installation seat 25 at right end of the housing 14 of the sewing machine 10. Therefore, it is unnecessary to additionally mount a fixing bracket on the rack of the sewing machine 10 for fixing the driving motor 13. Accordingly, the present invention has smaller structure and can be more easily transferred. Also, the assembling cost of the present invention is lowered.

The above flexible transmission members 23, 24 can be positive drive belts with multiple teeth. Alternatively, the transmission wheels and flexible transmission members of the present invention can be other transmission members.

The section of the sewing machine, which needs to be lubricated frequently, is totally isolated on the left side of the recessed installation space 18. In other words, the installation space 18 is always in a clean environment free from any lubricant. Therefore, the driving motor 13 mounted in the installation space 18 will not be contaminated by the lubricant. The lubricated section on the left side of the installation space 18 is identical to the conventional structure, in which the lubricant flows back to a lubricant pump (not shown) through a backflow passage 26 shown by phantom line.

The directly motor-driven structure of the sewing machine of the present invention has the following advantages:

1. The directly motor-driven structure includes a two-stage driving mechanism. The upper driving shaft and the lower driving shaft are drivingly connected via a middle rotary shaft. The distance between the second transmission mechanism and the upper stitching needle of the upper section is smaller than the distance between the first transmission mechanism and the lower stitching needle of the lower section. Therefore, the right side of the second transmission mechanism is formed with a recessed installation space in which the driving motor is installed. Therefore, the driving motor is coupled with the upper driving shaft, whereby the driving motor directly drives the upper driving shaft to reduce the noise and minify the vibration. In addition, by means of the recessed installation space, the driving motor is mounted in the housing of the sewing machine without protruding from the housing. Therefore, the original stability of the entire sewing machine will not be destructed.

2. The gravity center of the driving motor is in the housing of the sewing machine without suspending outside the housing. Therefore, the body of the sewing machine can be more firmly located without swinging.

3. By means of the middle rotary shaft, the transmission distance of the flexible transmission members between the driving motor and the lower driving shaft is shortened so as to reduce the noise in operation.

4. The driving motor is a high power motor with small volume, which can be directly fixedly mounted at right end of the housing of the sewing machine without using additional fixing structure. Therefore, the present invention has smaller volume and lighter weight.

5. In the directly motor-driven structure of the present invention, the flexible transmission members are all enclosed in the housing of the sewing machine without being exposed to outer side. Therefore, the safety in use can be ensured.

6. In the directly motor-driven structure of the present invention, the upper driving shaft is directly connected with the upper needle mechanism of the sewing machine so that the mechanical loss can be effectively reduced.

7. In the directly motor-driven structure of the present invention, the conventional fixing bracket for mounting the large motor is omitted. Therefore, the structure is simplified and the cost is lowered.

The above embodiments are only used to illustrate the present invention, not intended to limit the scope thereof. Many modifications of the above embodiments can be made without departing from the spirit of the present invention.

What is claimed is:

1. A directly motor-driven structure of a sewing machine, the sewing machine comprising:

(A) an upper driving shaft mounted on upper side of a housing of the sewing machine for driving an upper stitching needle;

(B) a lower driving shaft mounted on lower side of the housing for driving a lower stitching needle; and (C) a driving motor for driving the upper and lower driving shafts, making the upper and lower stitching needles perform sewing operation;

the directly motor-driven structure of a sewing machine comprising:

(a) a middle rotary shaft pivotally mounted in a middle section of the housing between the upper and lower driving shafts;

(b) a first transmission mechanism connected between the lower driving shaft and the middle rotary shaft to drivingly rotatably connect the lower driving shaft with the middle rotary shaft, the first transmission mechanism being spaced from the lower stitching needle by a first length; and (c) a second transmission mechanism connected between the upper driving shaft and the middle rotary shaft to drivingly rotatably connect the upper driving shaft with the middle rotary shaft, the second transmission mechanism being spaced from the upper stitching needle by a second length, the second length being smaller than the first length, whereby the sewing machine is formed with a recessed installation space adjacent to the second transmission mechanism, the driving motor being installed in the recessed installation space and directly fixedly connected with the upper driving shaft.

2. The directly motor-driven structure of the sewing machine as claimed in claim 1, wherein the first transmission mechanism includes:

(a) a first transmission wheel fixedly mounted on the lower driving shaft;

(b) a second transmission wheel fixedly mounted on the middle rotary shaft; and (c) a first flexible transmission member wound on the first and second transmission wheels, whereby the lower driving shaft is drivingly rotatably connected with the middle rotary shaft.

3. The directly motor-driven structure of the sewing machine as claimed in claim 1, wherein the second transmission mechanism includes:

(a) a third transmission wheel fixedly mounted on the upper driving shaft;

(b) a fourth transmission wheel fixedly mounted on the middle rotary shaft; and (c) a second flexible transmission member wound on the third and fourth transmission wheels, whereby the upper driving shaft is drivingly rotatably connected with the middle rotary shaft.

4. The directly motor-driven structure of the sewing machine as claimed in claim 2, wherein the first and second transmission wheels are belt wheels the rims of which are toothed and first and second flexible transmission members are positive drive belts having multiple teeth on inner circumferences.

5. The directly motor-driven structure of the sewing machine as claimed in claim 3, wherein the third and fourth transmission wheels are belt wheels the rims of which are toothed and first and second flexible transmission members are positive drive belts having multiple teeth on inner circumferences.

* * * * *